United States Patent [19]

Lyman

[11] 4,455,970

[45] Jun. 26, 1984

[54] ADD-ON BOILER

[75] Inventor: Joseph A. Lyman, 21 Park St., Rutland, Vt. 05701

[73] Assignees: Francis J. Lyman, Pittsford, Vt.; Theresa M. Jacobs, Ontario, Calif.; Lauralee A. Socia, Rutland, Vt.; Lawrence A. Lyman, Rutland, Vt.; Mary F. Lyman, Rutland, Vt.; Richard F. Sullivan, Rutland, Vt.; Joseph A. Lyman, Rutland, Vt. ; a part interest

[21] Appl. No.: 495,951

[22] Filed: May 19, 1983

[51] Int. Cl.[3] ..... F22B 33/00; F28F 7/00

[52] U.S. Cl. ..... 122/20 B; 165/DIG. 2; 122/14

[58] Field of Search ..... 122/13 R, 19, 14, 15, 122/20 B; 165/DIG. 2

[56] References Cited

U.S. PATENT DOCUMENTS

| | | | |
|---|---|---|---|
| 876,868 | 1/1908 | Dunn et al. | 122/20 B |
| 1,029,300 | 6/1912 | Jones | 122/15 |
| 1,564,621 | 12/1925 | Powers | 122/14 |
| 1,609,858 | 12/1926 | Bohon | 122/13 R |
| 1,991,557 | 2/1935 | Johnson | 122/14 |
| 2,035,341 | 3/1936 | Radloff | 165/158 |
| 2,566,327 | 9/1951 | Hallock | 126/442 |
| 3,499,423 | 3/1970 | Phlaum | 122/14 |
| 4,327,670 | 5/1982 | Teller | 122/20 B |
| 4,390,060 | 6/1983 | Reinke et al. | 165/DIG. 2 |

FOREIGN PATENT DOCUMENTS

| | | | |
|---|---|---|---|
| 2061476 | 5/1981 | United Kingdom | 165/DIG. 2 |

*Primary Examiner*—Henry C. Yuen

*Attorney, Agent, or Firm*—Walter F. Wessendorf, Jr.

[57] ABSTRACT

Disclosed is an add-on boiler that has an insulated cover covering a housing that carries a finned heat-recovery coil. The add-on boiler is mounted on the casing of a heating device to heat water in the coil with heat transferred by conduction and radiation. The insulated cover maintains the heated water in the coil at a high temperature to prevent the internal operating temperature of the heating device from dropping below the critical temperature at which creosote forms from the flue gases.

2 Claims, 3 Drawing Figures

ADD-ON BOILER

BACKGROUND OF THE INVENTION

1. Technical Field

This invention relates to an add-one boiler which can be removably mounted easily on the sides, top, bottom or back of a conventional radiant heating device, such as a wood-burning stove, to heat water for domestic hot water and/or hot water heating.

2. Background

The problem in the prior art is the need for an add-on boiler that can be removably mounted easily on a radiant heating device, such as a wood-burning stove, to transfer heat by conduction and radiation from the casing of such radiant heating device to the add-on boiler for domestic hot water and/or hot water heating without lowering the operating temperature of such radiant heating device below the critical 270° F. temperature below which creosote forms and is deposited from the flue gases.

Accordingly, the object of the invention is to contribute to the solution of the problems of the prior art by providing an add-on boiler that can be removably mounted easily on the sides, top, bottom or back of a radiant heating device, such as a wood-burning stove, to transfer heat by conduction and radiation from such radiant heating device to the add-on boiler for domestic hot water and/or hot water heating purposes without lowering the operating temperature of the radiant heating device below the critical 270° F. temperature at which creosote forms from the flue gases.

SUMMARY OF THE INVENTION

In accordance with the invention, there is provided an add-on boiler that has a finned heat-recovery coil that can be removably mounted easily on the flat surfaces of the sides, top, bottom or back of a radiant heating device to receive the heat transferred by conduction and radiation from such radiant heating device for domestic hot water and/or hot water heating purposes. The add-on boiler has an insulated cover that can be disposed and removably mounted easily over the finned heat-recovery coil to maintain the heated water in the pipes of the finned heat-recovery coil at a high temperature and thereby prevent the internal operating temperature in such radiant heating device from being lowered below the critical 270° F. temperature at which creosote would form in such radiant heating device from the flue gases.

BRIEF DESCRIPTION OF THE DRAWINGS

This object and other objects of the invention should be discerned and appreciated from the detailed description taken in conjunction with the drawings, wherein like reference numerals refer to similar parts throughout the several views, in which.

DESCRIPTION OF THE PREFERRED EMBODIMENT

Figure 1:
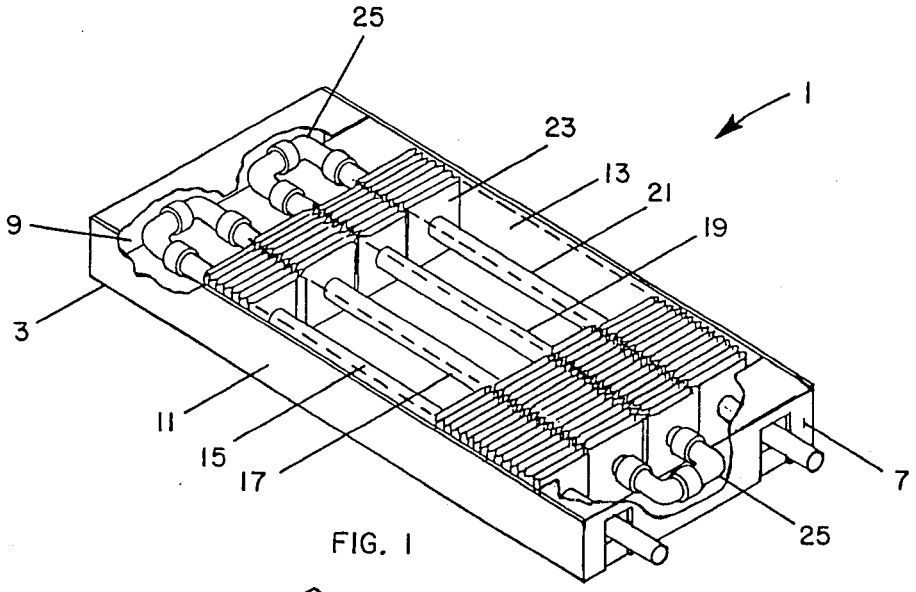
FIG. 1 is an inverted view of the housed, finned heat-recovery coil of an add-on boiler.

In FIG. 1 of the drawings, reference numeral 1 generally refers to the finned heat-recovery coil 1 of an add-on boiler unit.

The housed, finned heat-recovery coil 1 comprises a metal box-like housing 3 of rectangular configuration having a top 5, end walls 7 and 9 and side walls 11 and 13. Housing 3 mounts therein four parallel pipes 15, 17, 19 and 21 carrying in fixed relationship therewith radiating fins 23 which are in parallel relationship with one another. The pipes 15, 17, 19 and 21 are arranged and disposed serpentine-fashion in housing 3 via their elbowed end connectors 25, as shown, and define the finned heat-recovery coil 1.

Figure 3:
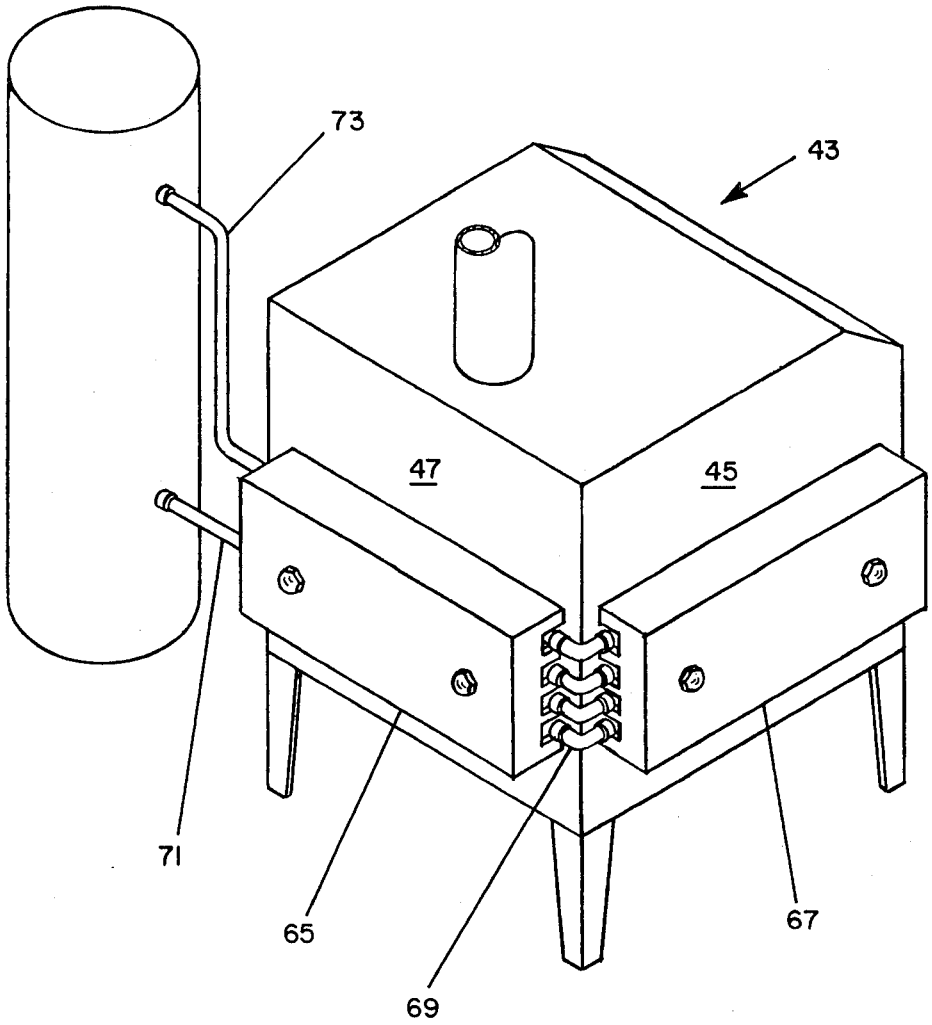
FIG. 3 is a view showing a radiant heating device with two add-on boilers operatively connected in series with one boiler unit mounted on the side and the other boiler unit mounted on the rear of such radiant heating device.

When a heat-recovery coil is to be operatively connected in series with another heat-recovery coil, all the pipes 15, 17, 19 and 21 of the first heat-recovery coil would extend beyond an end wall of its housing 3 to facilitate like interconnection with aligned pipes of the other heat-recovery coil, as shown in FIG. 3.

Figure 2:
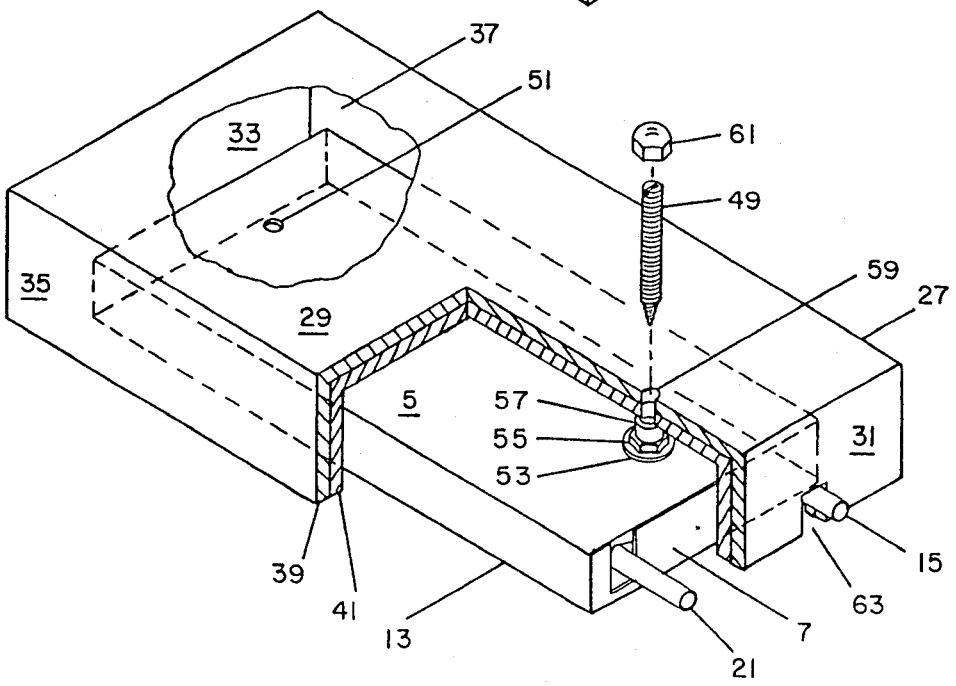
FIG. 2 is a view showing the add-on boiler and its housed, finned heat-recovery coil covered by the insulated cover.

FIG. 2 shows an insulated cover 27 of an add-on boiler mounted over housing 3. Such insulated cover 27 is of double-walled metal comprising a top 29, end walls 31 and 33 and side walls 35 and 37. Such double-walled construction of cover 27 sandwiches therebetween layers of insulation 39 and 41.

FIG. 3 shows a view of a radiant heating device 43 with two add-on boiler units interconnected in series and mounted on a side 45 and the rear 47 of the radiant heating device 43. Each of the add-on boiler units is removably mounted on a flat surface of such radiant heating device 43 by means of a pedestal-type threaded stud 49. Each of the studs 49 has a self-tapping screw end which is fixedly engaged with a pre-drilled locator hole in the casing of such radiant heating device 43 where such add-on boiler unit is to be mounted.

Two pedestal-type studs 49 are required to mount an add-on boiler to the stove casing. After such studs 49 have been fixedly engaged with such stove casing, housing 3 is appropriately disposed and positioned on the stove casing so that the studs 49 project through the mounting holes 51 formed in top 5 of the housing 3. Washers 53 are appropriately disposed over the threaded shank portions of the studs 49 and in bearing relationship against the mounting holes 51 followed by nuts 55 which are threadedly engaged with the threaded shank portions of the studs 49. Such nuts are tightened down against the washers 53 and hence against the housing top 5 to thereby removably mount the heat-recovery coil 1 on such stove casing.

Next spacer elements 57 are disposed upon the studs 49 and in bearing relationship against the housing top 5. Then the insulated cover 27 is appropriately disposed and positioned relative to housing top 5 so that the mounting holes 59 in the insulated cover top 29 are aligned with the corresponding holes 51 in the housing 5 so that the studs 49 project through such mounting holes 59. Next, acorn nuts 61 are threadedly engaged with the ends of the threaded shank portions of the studs 49 and are appropriately tightened down against the insulated cover top 29.

The lengths of the studs 49 remaining outside the stove casing can be adjusted by appropriately inward or outward movement of the self-tapping screw ends of the studs 49 relative to the pre-drilled locator holes in the stove casing so that the acorn nuts 61 will bear tightly against cover top 29.

As mounted on the stove casing and relative to each other, the top 5, end walls 7 and 9, and side walls 11 and 13, of the housing 3 will be in spaced relationship from and maintain air spaces between the corresponding top 29, end walls 31 and 33, and side walls 35 and 37, of the insulated cover 27.

When only one add-on boiler is to be mounted on the stove casing, two mounting slots 63 formed through the end wall 31 of the insulated cover 27 are utilized to allow the pipes 15 and 21 to project therethrough for appropriate operative connection with the hot and cold water fittings of a holding tank.

When add-on boiler units are to be mounted in series, as shown in FIG. 3, then one end wall of the insulated cover 27 of the first add-on boiler unit 65 would have two mounting slots 63 to allow the two end pipes 15 and 21 to extend therethrough and the other end wall of the insulated cover 27 of the first add-on boiler unit 65 would have four mounting slots 63 to allow all four pipes 15, 17, 19 and 21 to extend therethrough. The second add-on boiler unit 67 would only have four mounting slots 63 in an end wall of the insulated cover 27 to allow the four ends of the pipes 15, 17, 19 and 21 to extend therethrough for interconnection and communication via elbows 69 with the four ends 15, 17, 19 and 21 of the first boiler unit 65. The other end wall of the insulated cover 27 of the second boiler unit 67 would not have any mounting slots 63.

In heating water in a single add-on boiler, cold water enters from the cold water supply of the holding tank and the water in the pipes 15, 17, 19 and 21 are heated by conduction of heat via the radiating fins 23 in contact with the stove casing, and in addition such water is also heated by radiation of heat from such stove casing. The heated water will circulate through the pipes arranged serpentine-fashion and return to the hot water connection of the holding tank. If an add-on boiler is arranged and disposed on the side of a stove casing, as shown in FIG. 3, and with the pipes 15 and 21 at the same level as or above the cold water supply and hot water fittings of the holding tank, then convection will cause the heated water in the add-on boiler pipes to circulate and rise upward and with the hottest water returning to the hot water connection of the holding tank; otherwise, a pump must be utilized to pump the water through the pipes of the add-on boiler.

In heating water in add-on boiler units mounted in series, as shown in FIG. 3, cold water enters the lowermost pipe 71 in the first add-on boiler unit 65 and the aligned lowermost pipe in the second add-on boiler unit 67. Water in the pipes is heated by conduction of heat via the radiating fins 23 in contact with the stove casing, and in addition such water is also heated by radiation of heat from such stove casing. The temperature of the water will rise causing a difference in the weight or gravity of the water with the heaviest and coldest water remaining on the bottom and in the lowermost pipes in both boiler units, and with the hottest water rising to the top and being in the uppermost pipes of both boiler units. This resulting water motion, as a result of gravity action or convection, will cause the heated water in the pipes to circulate upward back and forth serpentine-fashion through the interconnected pipes of both boiler units with the hottest water returning to the hot water connection of the holding tank via the uppermost pipe 73 of the first boiler unit 65 immediately adjacent to such holding tank.

The add-on boiler can also be mounted on the bottom of the radiant heating device 43 to protect the floor from excess radiating heat and to also heat water at the same time. In fact, as an additional safety factor, the add-on boiler can be mounted on the radiant heating device 43 in such locations thereon to protect the wall or walls of a room from the effects of excess heat radiating from the stove in addition to heating water at the same time.

Having thusly described my invention, I claim:

1. An add-on boiler in combination with a wood-burning, radiant-heating device to heat water for domestic hot water and/or hot water heating, said radiant heating device having a casing, said add-on boiler having a housing, finned heat-recovery coil and an insulated cover, said housing mounting therein said finned heat-recovery coil, said housing having a top, end walls and side walls, said insulated cover having a top, end walls and side walls corresponding to said respective top, end walls and side walls of said housing, said insulated cover being in spaced relationship from said housing and maintaining air spaces between said corresponding tops, end walls and side walls of said insulated cover and housing, said finned heat-recovery coil having pipes interconnected serpentine-fashion and fixed radiating fins, said radiating fins being in contact with the external surface of said casing of said radiant-heating device to conduct heat from said external casing surface to heat water in said pipes of said heat-recovery coil and to heat the water in said pipes of said heat-recovery coil by radiation of heat from said external casing surface, said insulated cover covering said heat-recovery coil and maintaining the heated water in said pipes of said heat-recovery coil at a sufficiently high-enough temperature to prevent the internal operating temperature in said radiant heating device from dropping below the critical temperature at which creosote forms and is deposited from the flue gases.

2. An add-on boiler in accordance with claim 1, wherein said insulated cover has insulating material, and wherein said insulated cover is of double-walled construction sandwiching therebetween said insulating material.

* * * * *